US005836403A

United States Patent [19]

Putney et al.

[11] Patent Number: 5,836,403

[45] Date of Patent: Nov. 17, 1998

[54] REVERSIBLE HIGH IMPACT MECHANISM

[75] Inventors: Gordon A. Putney, Lake Geneva; Dean J. Iwinski, Muskego, both of Wis.

[73] Assignee: Snap-on Technologies, Inc., Lincolnshire, Ill.

[21] Appl. No.: 741,666

[22] Filed: Oct. 31, 1996

[51] Int. Cl.[6] ..... B25D 15/00

[52] U.S. Cl. ..... 173/205; 173/203; 173/93.5; 173/109; 74/58

[58] Field of Search ..... 173/93, 93.5, 203, 173/205, 124, 111, 176, 178, 104, 109; 74/58

[56] References Cited

U.S. PATENT DOCUMENTS

| | | | |
|---|---|---|---|
| 2,160,150 | 5/1939 | Jimerson et al. . | |
| 2,439,823 | 4/1948 | Porter | 173/93.5 |
| 2,712,254 | 7/1955 | Schodeberg . | |
| 2,756,853 | 7/1956 | Madsen . | |
| 2,821,276 | 1/1958 | Reynolds . | |
| 2,825,436 | 3/1958 | Amtsberg . | |
| 2,881,885 | 4/1959 | Short . | |
| 2,907,240 | 10/1959 | Schwenk et al. . | |
| 2,973,071 | 2/1961 | Sturrock . | |
| 3,001,428 | 9/1961 | Sindelar . | |
| 3,001,429 | 9/1961 | Sindelar . | |
| 3,174,597 | 3/1965 | Schaedler et al. . | |
| 3,198,303 | 8/1965 | Brown . | |
| 3,414,066 | 12/1968 | Wallace . | |
| 3,465,602 | 9/1969 | Garaud | 74/58 |
| 3,610,344 | 10/1971 | Schoeps . | |
| 3,703,933 | 11/1972 | Schoeps | 173/178 |
| 3,714,994 | 2/1973 | Zoerner et al. . | |
| 3,741,313 | 6/1973 | States | 173/176 |
| 3,741,314 | 6/1973 | Leoni et al. . | |
| 3,760,886 | 9/1973 | Mori et al. . | |
| 3,789,896 | 2/1974 | Cooke-Yarborough | 173/93 |
| 3,804,180 | 4/1974 | Gelfand et al. . | |
| 3,908,768 | 9/1975 | Hess . | |
| 4,232,750 | 11/1980 | Antipov et al. . | |
| 4,535,642 | 8/1985 | Ohmura | 74/58 |
| 4,557,337 | 12/1985 | Shibata . | |
| 4,585,078 | 4/1986 | Alexandrov et al. . | |
| 4,653,359 | 3/1987 | Liao | 173/93 |
| 4,817,736 | 4/1989 | Ono . | |
| 4,867,250 | 9/1989 | Ono . | |
| 4,947,939 | 8/1990 | Hung . | |
| 4,991,472 | 2/1991 | Hollingsworth . | |
| 5,092,410 | 3/1992 | Wallace et al. . | |
| 5,156,244 | 10/1992 | Pyles et al. | 173/178 |
| 5,199,505 | 4/1993 | Izumisawa . | |
| 5,361,852 | 11/1994 | Inoue et al. | 173/176 |
| 5,412,546 | 5/1995 | Huang . | |
| 5,435,398 | 7/1995 | Juan . | |
| 5,730,232 | 3/1998 | Mixer | 173/176 |

FOREIGN PATENT DOCUMENTS

| | | |
|---|---|---|
| 7334121 | 4/1974 | France . |
| 1087538 | 8/1960 | Germany . |
| 1478809 | 2/1969 | Germany . |
| 1478807 | 3/1969 | Germany . |

*Primary Examiner*—Scott A. Smith
*Assistant Examiner*—John Paradiso
*Attorney, Agent, or Firm*—Emrich & Dithmar

[57] ABSTRACT

A reversible rotary wrench includes an impact mechanism for applying intermittent torque impulses to a load. The mechanism includes a rotatable shaft having an axis and adapted to be coupled to a motive source, a rotatable anvil for coupling to the load and having a pair of anvil ears, a tubular hammer substantially coaxial with the shaft and having a pair of hammer ears engageable with the anvil ears and a rotatable tubular drive coupling member substantially coaxial with the shaft. The mechanism also includes a first helical cam structure coupling the drive coupling member to the shaft, a second helical cam structure coupling the drive coupling member to the hammer, and a spring biasing the hammer axially toward the anvil to engage the hammer ears with the anvil ears. When the shaft is rotated in a first helical direction and torque exerted by the anvil on the hammer exceeds a given threshold, the sleeve rotates and the first cam structure responds to rotation of the shaft to move the hammer axially away from the anvil thereby disengaging the hammer from the anvil. When the shaft is rotated in a second direction and torque exerted by the anvil on the hammer exceeds a given threshold, the second cam structure responds to rotation of the shaft to move the hammer axially away from the anvil thereby disengaging the hammer from the anvil.

14 Claims, 8 Drawing Sheets

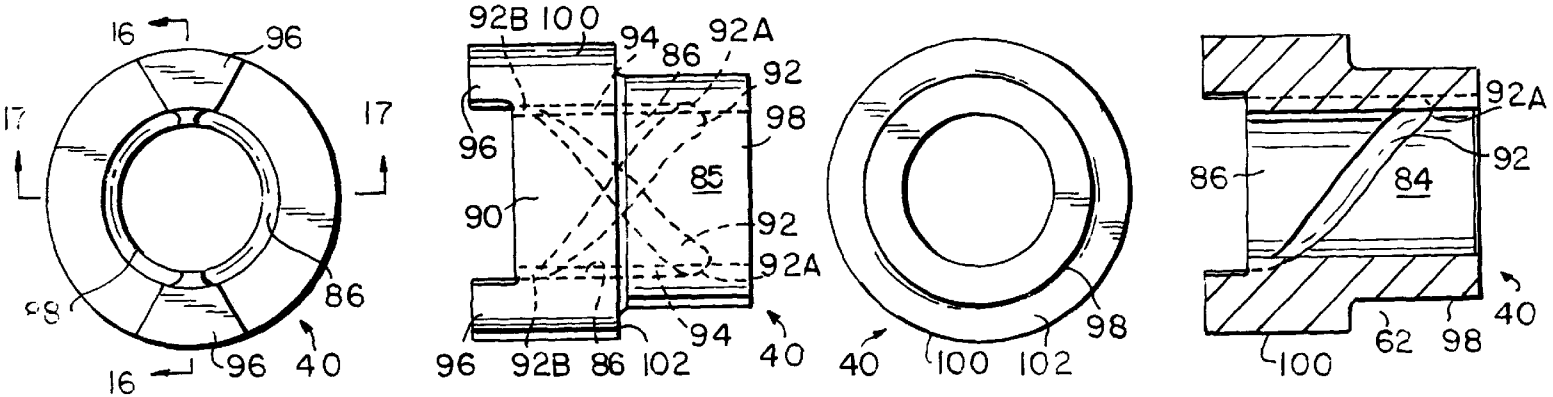
FIG. 16
FIG. 15
FIG. 14
FIG. 13
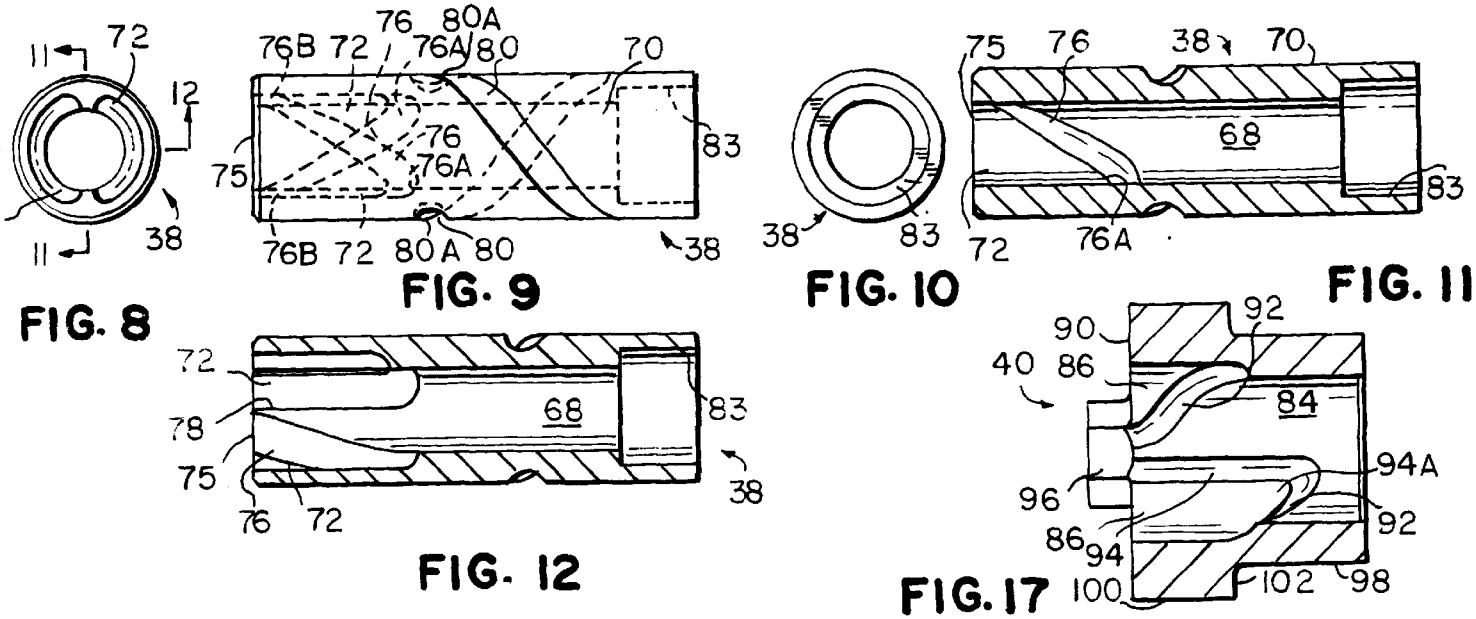
FIG. 11
FIG. 10
FIG. 9
FIG. 8
FIG. 12
FIG. 17

REVERSIBLE HIGH IMPACT MECHANISM

BACKGROUND OF THE INVENTION

1. Field of the Invention

This invention relates to motorized hand tools, in particular to impact wrenches.

2. Description of the Prior Art

Impact wrenches for applying intermittent torque impulses to tighten or loosen a fastener of a fastener joint are well known. In the past, the amount of momentum output most reversible impact mechanisms of these impact wrenches could deliver were limited. These prior mechanisms include a rotatable drive shaft connected to a motor, a hammer having a pair of ears disposed about and coupled to the shaft, and an anvil engageable with a load, either directly or by means of a socket. The anvil has a pair of ears engageable with the ears of the hammer. These impact mechanisms also include a spring for biasing the hammer toward the anvil to engage the hammer ears with the anvil ears and a cam mechanism to allow the hammer to rotate with respect to the shaft and to move axially along the shaft away from the anvil when resistance torque builds up in the fastener joint. The cam mechanism includes a V-shaped cam ramp or groove on the exterior of the drive shaft and a matching V-shaped cam ramp on the interior surface of the hammer and a ball disposed in the ramp. When the drive shaft rotates clockwise and enough resistance torque is built up, the cam mechanism causes the hammer to move axially away from the anvil as the ball travels on one respective side of the V of each ramp. When the shaft rotates counterclockwise, the ball travels on the other respective side of the V of each ramp as the hammer retracts axially. The spring then causes the hammer to move axially and rotatably and accelerate toward and impact the anvil and coupled fastener. The greater the distance that the hammer moves axially away from the anvil, the greater the impact it can exert on the anvil. The hammer is, however, limited in its axial movement by the length of each side of the ramp. If the length of the sides of the ramp are increased, they will eventually intersect with each other, which will disable the balls, or a longer or wider impact mechanism will result which is more costly to manufacture and less convenient to use. Additionally, higher powered motors could be used to increase the momentum impact, but again these are more costly and are larger.

SUMMARY OF THE INVENTION

It is a general object of the invention to provide an improved impact mechanism which avoids the disadvantages of prior impact mechanisms while affording additional structural and operating advantages.

An important feature of the invention is the provision of a reversible impact mechanism which is of relatively simple and economical construction.

Another feature of the invention is the provision of an impact mechanism of the type set forth, which can provide high torque impulses to a load with a small conventional motor.

A further feature of the invention is the provision of an impact mechanism of the type set forth, which is compact, yet can provide high torque impulses to a load with a small conventional motor.

These and other features of the invention are attained by providing a reversible rotary impact mechanism for applying intermittent torque impulses to a load. The mechanism includes a shaft rotatable about an axis and adapted to be coupled to a motive source, a rotatable anvil for coupling to the load and having a pair of anvil ears, an axially and rotatably movable tubular hammer substantially coaxial with the shaft and having a pair of hammer ears engageable with the anvil ears and a rotatable tubular drive coupling member substantially coaxial with the shaft. The mechanism also includes a first helical cam structure coupling the drive coupling member to the shaft, a second helical cam structure coupling the drive coupling member to the hammer, and a bias member resiliently biasing the hammer axially toward the anvil to engage the hammer ears with the anvil ears. When the shaft is rotated in a first helical direction and torque exerted by the anvil ears on the hammer ears exceeds a given threshold, the sleeve rotates and the first cam structure responds to rotation of the shaft to move the hammer axially away from the anvil thereby disengaging the hammer ears from the anvil ears. When the shaft is rotated in a second direction and torque exerted by the anvil ears on the hammer ears exceeds a given threshold, the second cam structure responds to rotation of the shaft to move the hammer axially away from the anvil thereby disengaging the hammer ears from the anvil ears.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 8 is a front end elevational view of the directional sleeve of the impact mechanism of FIG. 1;

FIG. 9 is a side elevational view of the sleeve of FIG. 8;

FIG. 10 is a rear end elevational view of the sleeve of FIG. 8;

FIG. 11 is a sectional view taken generally along the line 11—11 of FIG. 8;

FIG. 12 is a sectional view taken generally along the line 12—12 of FIG. 8;

FIG. 13 is a front end elevational view of the hammer of the impact mechanism of FIG. 1;

FIG. 14 is a side elevational view of the hammer of FIG. 13;

FIG. 15 is a rear end elevational view of the hammer of FIG. 13;

FIG. 16 is a sectional view taken generally along the line 16—16 of FIG. 13;

FIG. 17 is a sectional view taken generally along the line 17—17 of FIG. 13;

DETAILED DESCRIPTION OF THE PREFERRED EMBODIMENT

Figure 1:
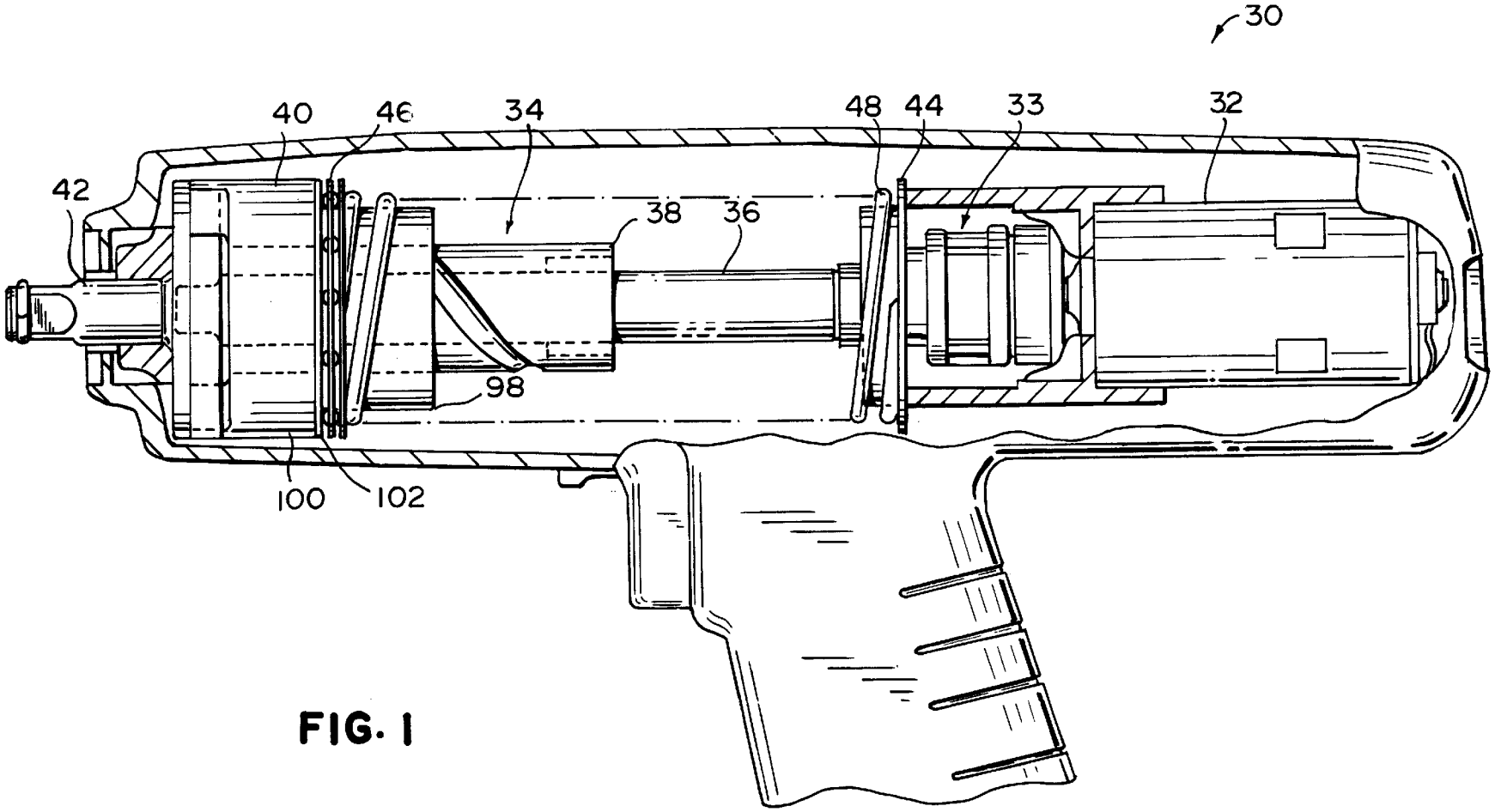
FIG. 1 is a fragmentary side elevational view of an impact wrench, partially broken away to illustrate the reversible, high impact mechanism of the present invention.

Referring to FIG. 1, an impact wrench 30 includes a motor 32 and a reversible rotary impact mechanism 34 for applying intermittent torque impulses to a load, such as a fastener of a fastener joint (not shown).

Figure 2:
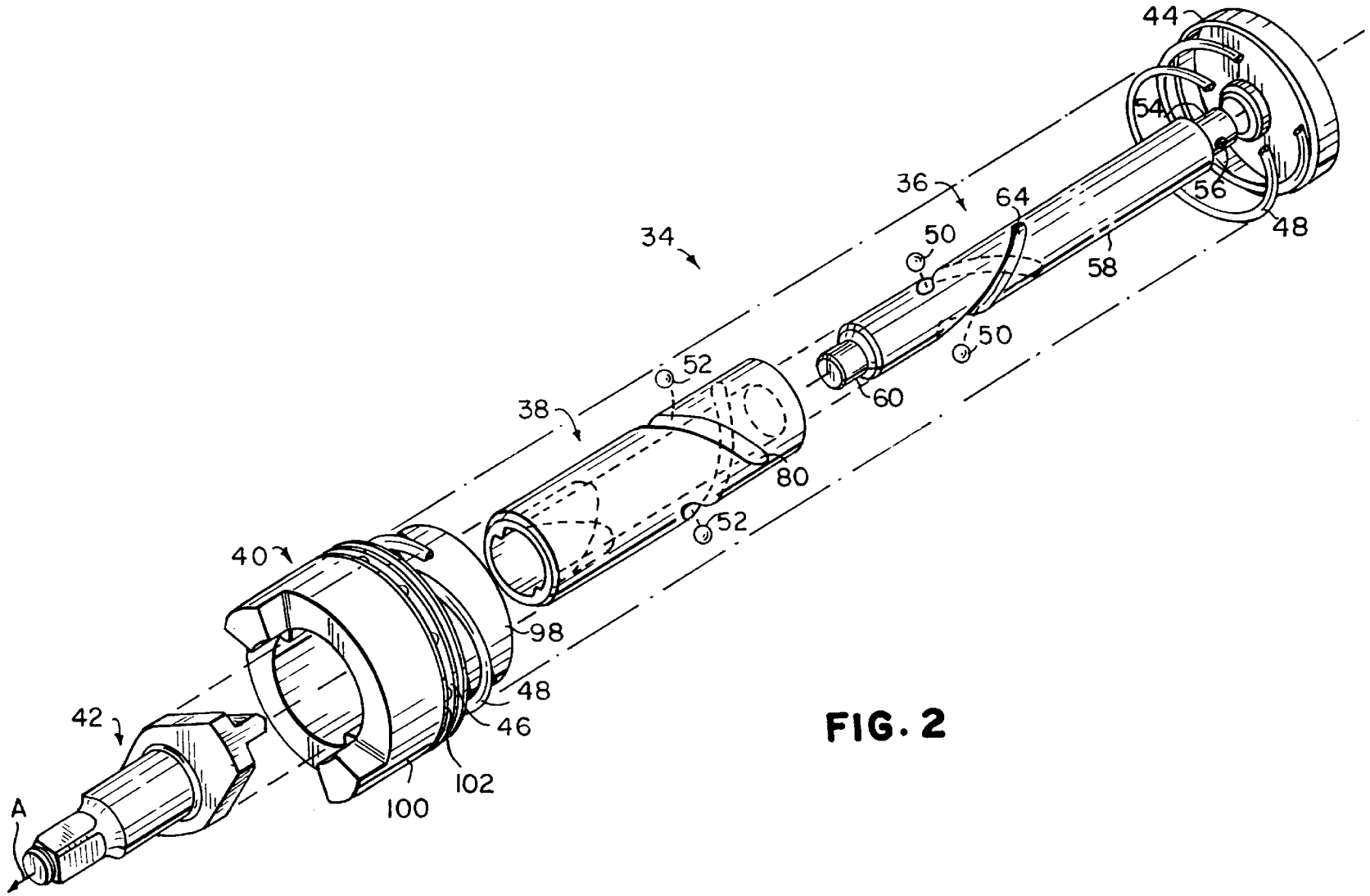
FIG. 2 is an exploded perspective view of the impact mechanism of FIG. 1.
Figure 6:
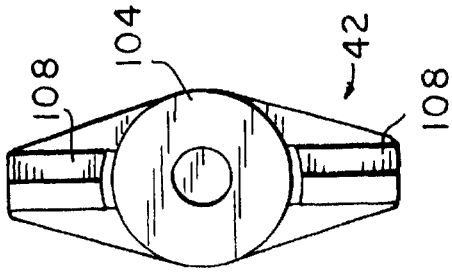
FIG. 6 is a rear elevational view of the anvil of FIG. 3.
Figure 5:
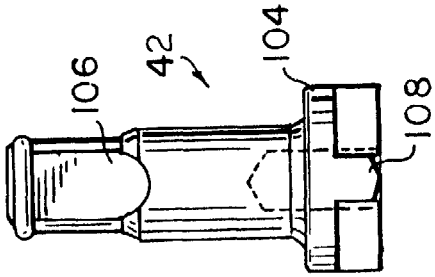
FIG. 5 is a bottom plan view of the anvil of FIG. 3.
Figure 4:
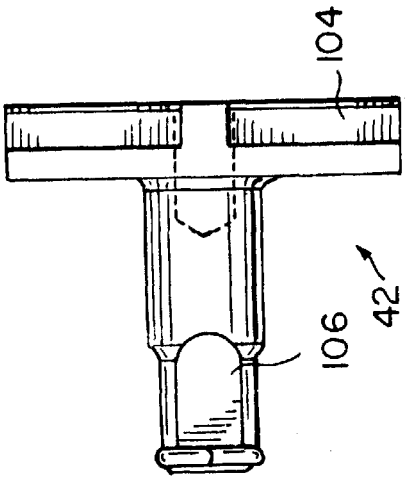
FIG. 4 is a side elevational view of the anvil of FIG. 3.
Figure 3:
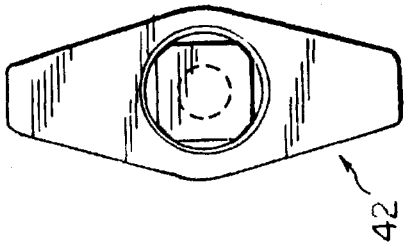
FIG. 3 is a front elevational view of the anvil of the impact mechanism of FIG. 1.

Referring also to FIG. 2, the impact mechanism 34 includes a drive shaft 36 coupled to the motor 32 via a gear assembly 33, a tubular drive coupling member or directional sleeve 38 disposed coaxially about the drive shaft 36, a tubular hammer 40 disposed coaxially about the directional sleeve 38, an anvil 42 engageable with the hammer 40 and disposed at the front end of the drive shaft 36, a thrust washer 44 disposed at the rear end of the drive shaft 36, a thrust bearing 46 disposed about a portion of the hammer 40, and a helical compression spring 48 disposed between the thrust washer 44 and the thrust bearing 46.

The impact mechanism 34 also includes a pair of balls 50 disposed between the drive shaft 36 and directional sleeve 38 and another pair of balls 52 disposed between the sleeve 38 and hammer 40.

Figure 7:
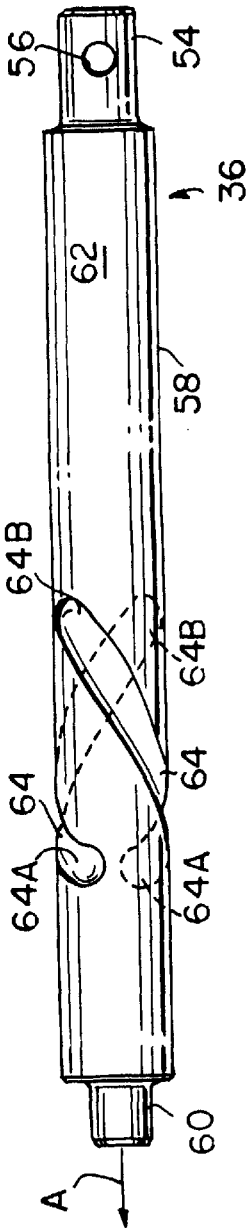
FIG. 7 is a side elevational view of the shaft of the impact mechanism of FIG. 1.
Figure 19A:
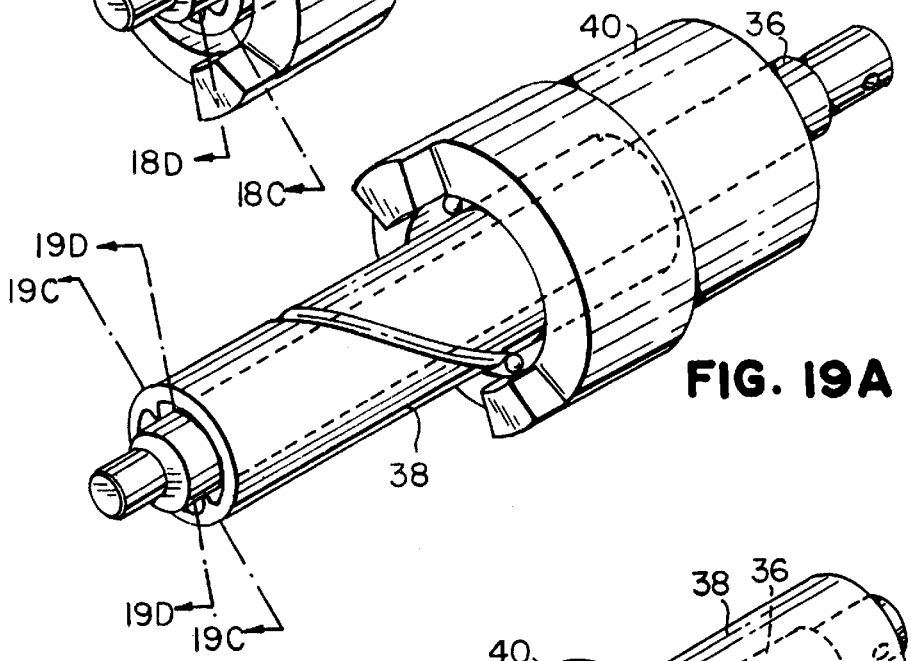
FIG. 19A is a view similar to FIG. 18A with the impact mechanism shown in a non-engaged condition when the shaft is rotating clockwise.
Figure 20A:
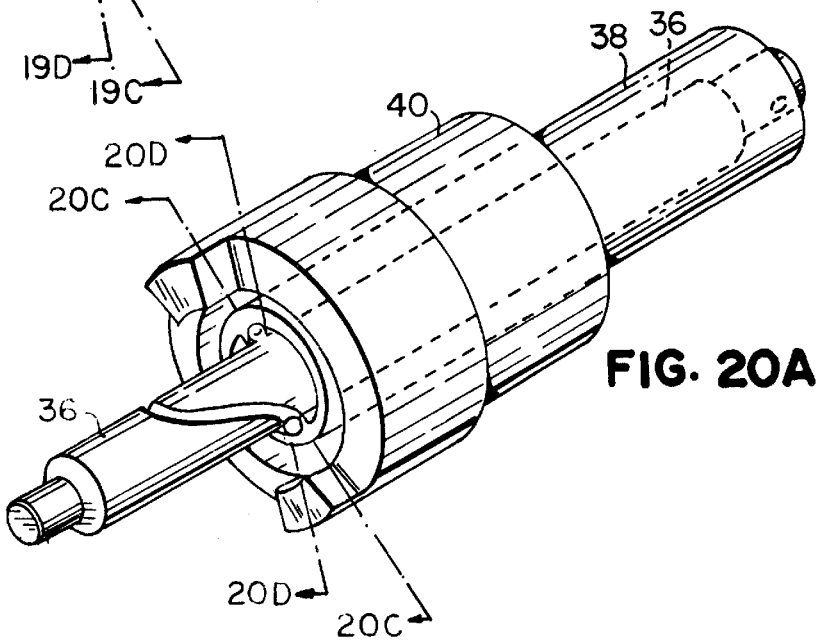
FIG. 20A is a view similar to FIG. 18A with the impact mechanism shown in a non-engaged condition when the shaft is rotating counterclockwise.

As seen best in FIGS. 2 and 7, the drive shaft 36 is substantially cylindrical and has a longitudinal axis A and a reduced diameter coupling section 54 having a bore 56 therethrough perpendicular to the axis A. The coupling section 54 is coupled to the motor 32 by a pin (not shown) through the bore 56 or other conventional process. The drive shaft 36 also includes a larger diameter central section 58 and a reduced diameter anvil alignment end section 60.

The central section 58 has a cylindrical exterior surface 62 having a pair of substantially identical helical grooves 64 formed therein. The helical grooves 64 have the same pitch and are so positioned that the ends of one groove 64 are, respectively, diametrically opposite the corresponding ends of the other groove. The grooves 64 extend helically in a first rotational direction about the axis A.

Referring to FIGS. 2 and 8–12, the directional sleeve 38 is tubular, substantially coaxial with the drive shaft 36 and has interior and exterior surfaces 68 and 70. The directional sleeve 38 has two substantially identical triangular recesses 72 formed in the interior surface 68 at a front end 75 of the directional sleeve 38. Each recess 72 defines a sloped helical ramp 76 and a stop shoulder 78 (which intersects the sloped ramp 76) extending parallel to the longitudinal axis. Each sloped ramp 76 extends helically in the same rotational direction about the axis A as the grooves 64 do.

The exterior surface 70 of the directional sleeve 38 also has two substantially identical helical grooves 80 which have the same pitch and are so positioned that the ends of one groove 64 are, respectively, diametrically opposite the corresponding ends of the other groove. The grooves 80 each extend helically in a rotational direction about the axis A which is opposite to that of the grooves 64 of the drive shaft 36. The directional sleeve 38 also has a counterbore 83 at its rear end.

The hammer 40, as seen in FIGS. 2 and 13 through 17, is tubular, coaxial with the drive shaft 36 and has an interior surface 84 disposed about the directional sleeve 38 and an exterior surface 85. The hammer 40 has two substantially identical triangular-shaped recesses 86 formed in the interior surface 84 at a front end 90 thereof. Cavities 86 respectively define sloped, helical ramps 92 along and stop shoulders 94 (which intersects the sloped ramp 92) and extend parallel to the axis A. The sloped ramps 92 each extend helically about the axis A in the same rotational direction as grooves 80 of the directional sleeve 38. The hammer 40 also has two ears 96 disposed about 180 degrees apart and projecting axially from front end 90. The exterior surface 85 has a smaller diameter section 98 and a larger diameter section 100 and a radial annular shoulder 102 formed therebetween.

As seen in FIGS. 1 and 2, the thrust bearing 46 is disposed about the smaller diameter section 98 of the hammer 40 and abuts the shoulder 102. Also, a portion of the compression spring 48 is disposed about the smaller diameter section 98 and abuts the thrust bearing 46.

The anvil 42, as seen in FIGS. 2–6, is generally T-shaped and has an impact section 104 and a square drive fastener section 106 for coupling to a socket or the like. The impact section 104 includes two ears 108, respectively engageable with the ears 96 of the hammer 40, and an alignment bore 110 in which the alignment end section 60 of the drive shaft 36 is disposed.

Referring to FIGS. 18A–18D, two tracks 112 are defined between the drive shaft 36 and the sleeve 38. Each track 112 is defined by one of the grooves 64 of the drive shaft 36 and the sloped ramp 76 and stop wall 78 of a corresponding one of the triangular recesses 72 of the directional sleeve 38. The balls 50 are respectively disposed in the tracks 112. The balls 50 and the tracks 112 define a cam structure 115 that couples the drive shaft 36 to the directional sleeve 38 and that allows the directional sleeve 38 to move axially and rotatably with respect to the drive shaft 36.

Similarly, two tracks 116 are defined between the hammer 40 and the sleeve 38. Each track 116 is defined by one of the helical grooves 80 of the directional sleeve 38, and the sloped ramp 92 and the stop wall 94 of a corresponding one of the triangular recesses 86 of the hammer 40. Balls 52 are respectively disposed in the tracks 116. The balls 52 and tracks 116 define a cam structure 119 that couples the directional sleeve 38 to the hammer 40 and that allows the hammer 40 to move axially and rotatably with respect to the directional sleeve 38.

Figure 18A:
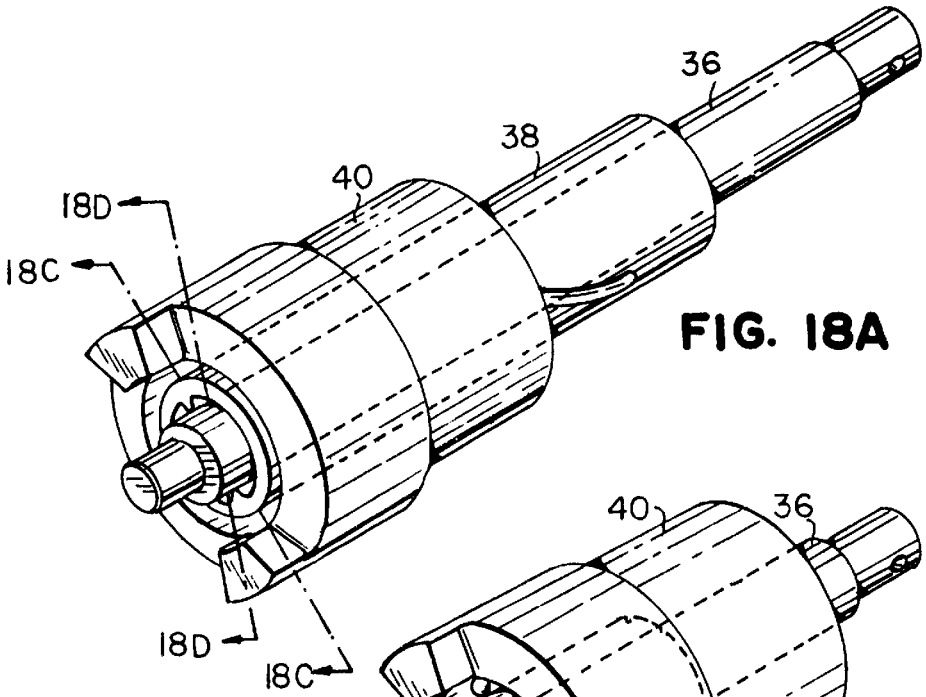
FIG. 18A is an enlarged, perspective view of a portion of the impact mechanism of FIG. 2 shown in an engaged condition.
Figure 18B:
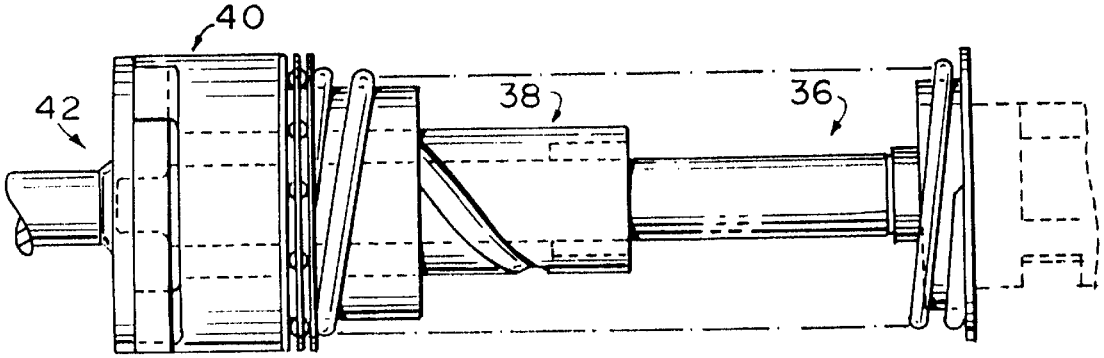
FIG. 18B is an enlarged, fragmentary, side elevational view of the impact mechanism of FIG. 2.
Figure 18C:
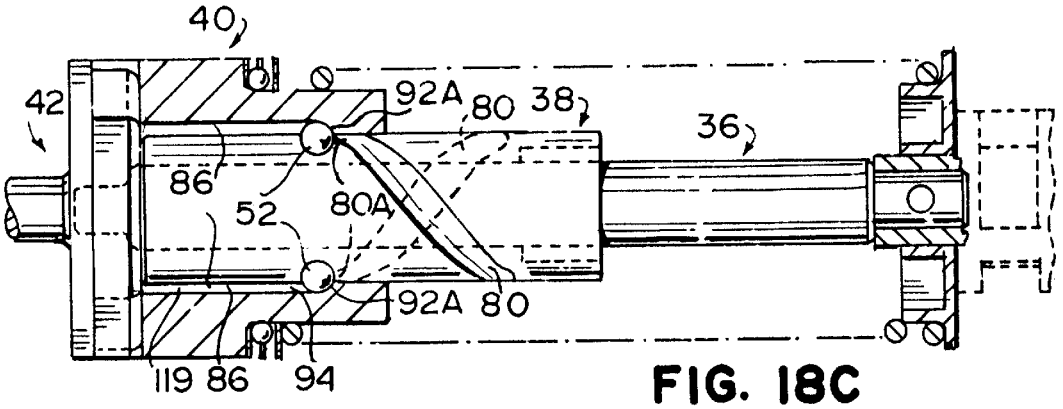
FIG. 18C is an enlarged sectional view of the impact mechanism of FIG. 2, taken generally along line 18C—18C of FIG. 18A.
Figure 18D:
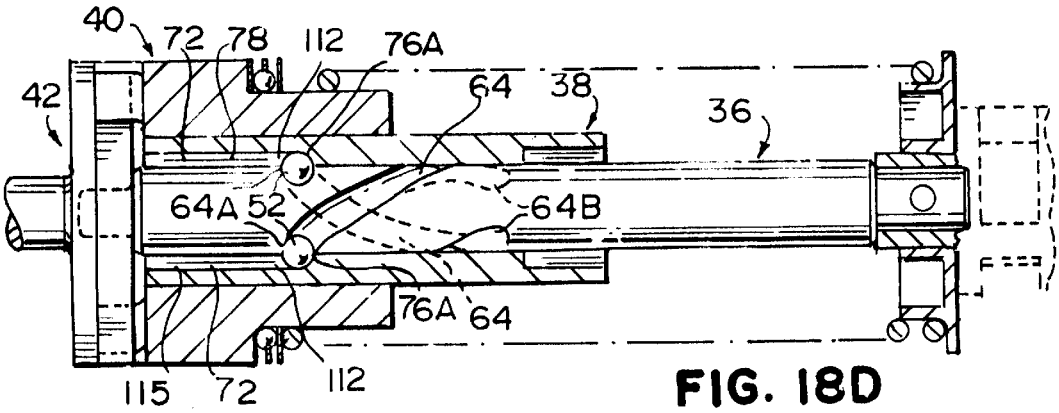
FIG. 18D is an enlarged sectional view of the impact mechanism of FIG. 2, taken generally along line 18D—18D of FIG. 18A.

The operation of the impact mechanism 34 will now be described. The fastener section 106 of the anvil 42 is coupled to a socket or the like, which is coupled to a fastener, such as a nut, or the like, of a fastener joint. The motor 32 causes the coupled drive shaft 36 to rotate. When there is little or no torque resistance from the fastener, the impact mechanism 34 is in the condition shown in FIGS. 18A–D. The compression spring 48 axially forces the hammer 40 against anvil 42 so the ears 96 of the hammer 40 contact and engage the ears 108 of the anvil 42. As seen in FIG. 18D, the drive shaft 36 is coupled to the directional sleeve 38 by the balls 50, which are respectively disposed at the front ends 64A of the grooves 64 of the drive shaft 36 and at the rear ends 76A of the sloped ramps 76. Similarly, as seen in FIG. 18C, the directional sleeve 38 is coupled to the hammer 40 by the balls 52, which are respectively disposed at the rear ends 80A of the grooves 80 of the directional sleeve 38 and at front ends 92A of the sloped ramps 92. Therefore, the drive shaft 36 is coupled to the hammer 40 and, when the drive shaft 36 rotates, it rotates the hammer 40. The ears 96 of the hammer 40 engage the ears 108 of the anvil 42 and cause the anvil 42 and the fastener coupled thereto to rotate with the drive shaft 36 to loosen or tighten the fastener.

As the resistance torque builds up in the fastener joint due to the thread friction, the anvil 42 tends to slow down, creating a speed differential between the anvil 42 and the shaft 36, which is being rotated at a substantially constant speed by the motor 32. The screw-like action of the cam structures 115, 119 cause the hammer 40 to be moved axially rearwardly, away from the anvil 42, in one of two ways, depending on the direction the drive shaft 36 is rotating.

Figure 19B:
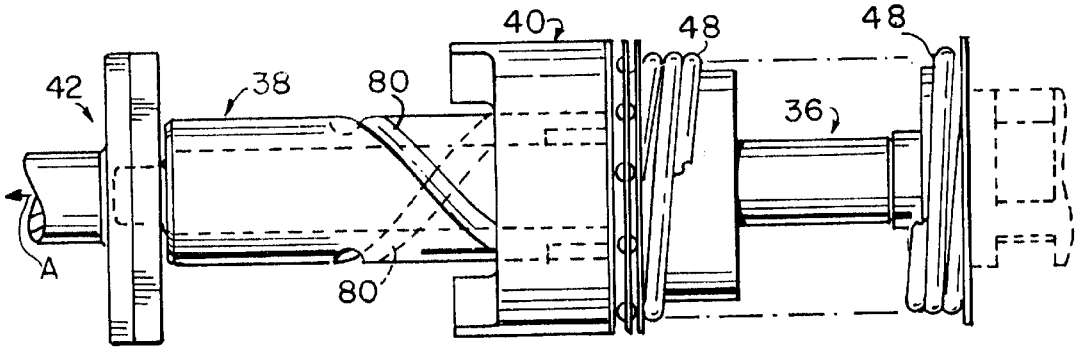
FIG. 19B is a view similar to FIG. 18B of the impact mechanism in the condition of FIG. 19A.
Figure 19C:
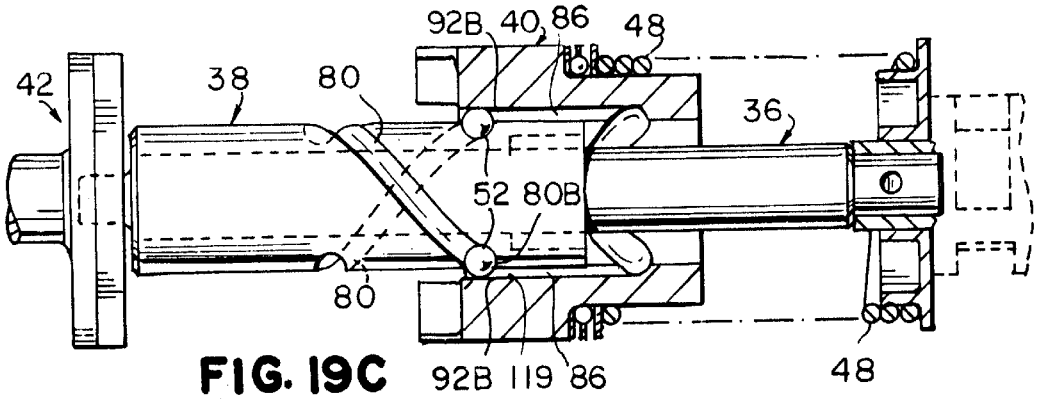
FIG. 19C is a view similar to FIG. 18C taken generally along line 19C—19C of FIG. 19A.
Figure 19D:
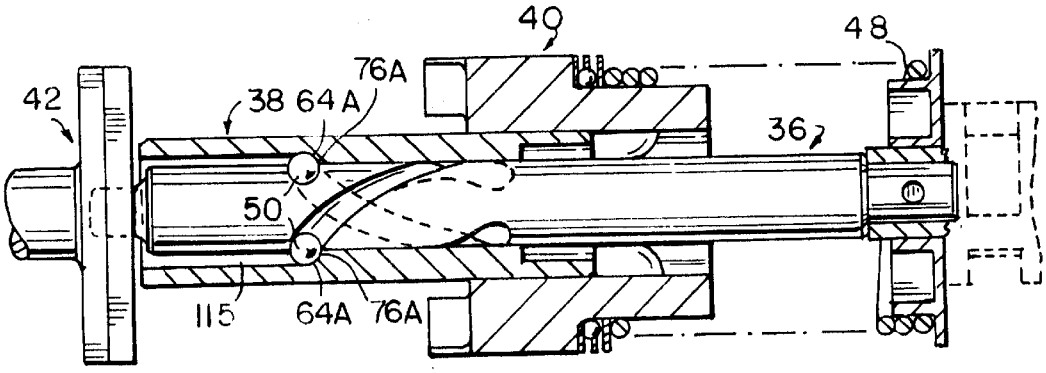
FIG. 19D is a view similar to FIG. 18D taken generally along line 19D—19D of FIG. 19A.
Figure 20B:
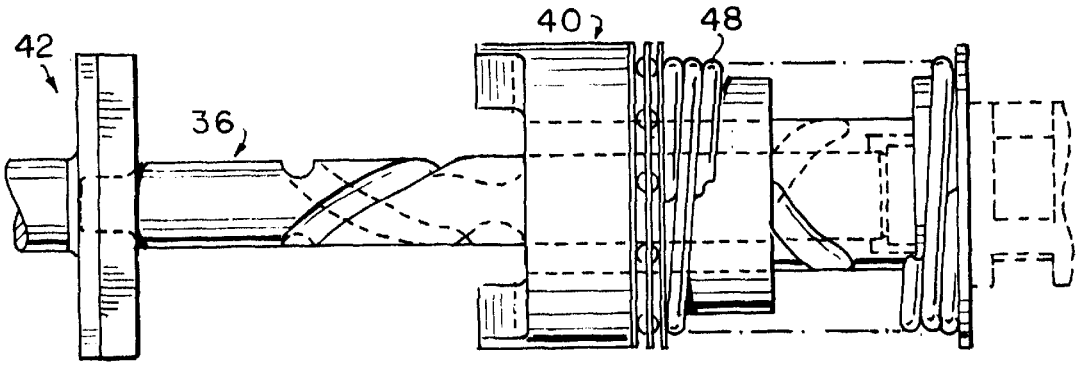
FIG. 20B is a view similar to FIG. 18B of the impact mechanism in the condition of FIG. 20A.
Figure 20C:
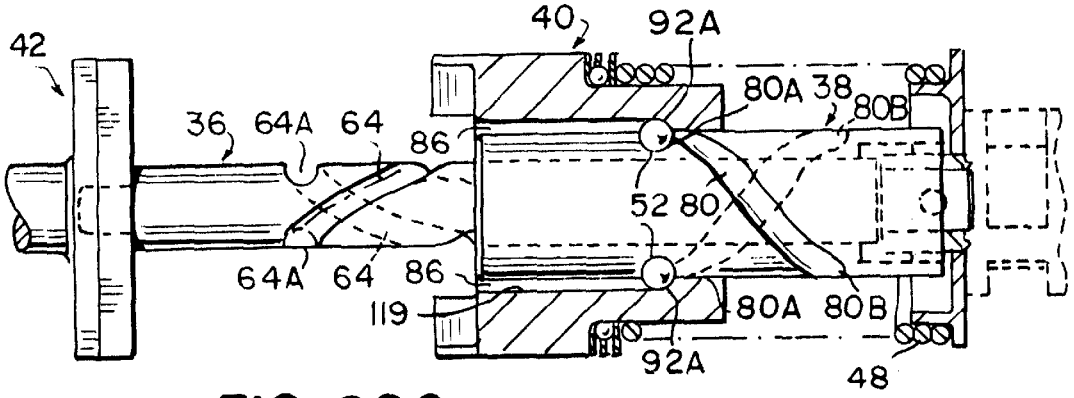
FIG. 20C is a view similar to FIG. 18D taken generally along line 20C—20C of FIG. 20A.
Figure 20D:
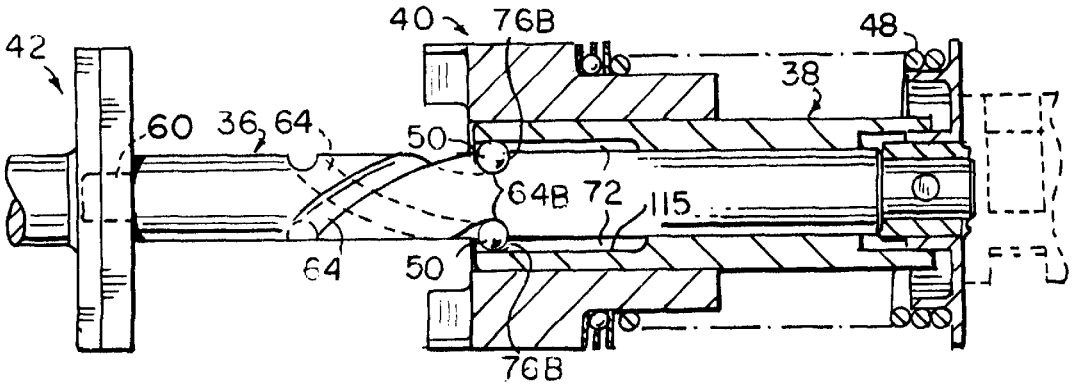
FIG. 20D is an enlarged sectional view taken generally along line 20D—20D of FIG. 20A.

If, as seen in FIGS. 19A–D, the drive shaft 36 is rotating clockwise about its axis A, balls 50, remain in the same position, as is seen by comparing FIGS. 18D and 19D, and the directional sleeve 38 continues to rotate with the drive shaft 36. This is because the balls 50 are at the front ends 64A of the grooves 64 and at the rear ends 92A of the sloped ramps 92 and in contact with the stop walls 78 of the recesses 72, which prevents clockwise rotation of the shaft 36 relative to directional sleeve 38. However, because the grooves 80 on the directional sleeve 38 extend helically in a rotational direction about the axis A opposite to that of the grooves 64 of the drive shaft 36, the speed differential between the anvil 42 and the sleeve 38 causes the anvil 42 to "screw" itself back along the tracks 112. Thus, the balls 52 of cam structure 115 are pushed from the front ends 80A of the grooves 80 toward the rear ends 80B thereof. As the hammer 40 moves axially away from the anvil 42, it compresses the spring 48 thereby storing up spring energy.

Initially, when the hammer 40 moves for the first time axially rearward and the hammer ears 96 first clear the anvil ears 108, the energy of the compression spring 48 is caused to be released which axially pushes the hammer 40 toward the anvil 42, the balls 52 travelling in a direction from the rear ends 80B back toward front ends 80A of the grooves 80, so that the hammer 40 is rotationally accelerated with respect to the drive shaft 36, and its ears 96 strike the ears 108 of the anvil 42 (180 degrees from the last point of contact between the ears 96 and 108) with a high impact to tighten or loosen the coupled fastener of the fastener joint.

As long as the resistance torque in the fastener joint is above a given threshold when the ears 96 of the hammer 40 impact the ears 108 of the anvil 42, the hammer 40 will again move axially away from the anvil 42. As the fastener is tightened, the stiffness of the joint increases and acts like a torsion spring. After the hammer 40 imparts its energy into the anvil (and the joint), the joint components twist backwards and (together with speed differential, described above) cause the hammer 40 to rebound and screw itself further axially back (an axial distance greater than just described above) up the tracks 112. Depending upon the amount of rebound exerted by the joint on the hammer 40, the hammer 40 will move axially rearwardly along the shaft until the axial force of the hammer 40 is less than the stored force of the compression spring 48 or until the balls 52 reach the rear ends 80B of the grooves 80 which prevent further axial rearward movement of the hammer 40. When the hammer 40 stops its axial movement, the energy of the compression spring 48 is released and causes the hammer 40 to accelerate helically forward and impact the anvil 42 again. As long as the resistance torque of the fastener joint is great enough, the hammer 40 will repeatedly strike the anvil 42 with a high impact, as described above.

Depending on how far the hammer 40 has travelled axially rearward, the ears 96 of the hammer 40 will engage the ears 108 of the anvil 42, 180 degrees, 360 degrees, 540 degrees or more from the ears 96 and 108 last point of contact. Additionally, the further the axial rearward travel of the hammer 40, the greater the time for the hammer 40 to rotationally accelerate with respect to the drive shaft 36 and the greater amount of force it can impart to the anvil 42 and the joint.

If the resistance torque has built up in the fastener joint and the directional sleeve 38 is rotating counterclockwise about the axis A, the hammer 40 is moved axially away from the anvil 42 in a different way than that shown in FIGS. 19A–19D. As seen in FIGS. 20A–D, when the drive shaft 36 is rotating counterclockwise about its axis A (FIG. 20B), balls 52, disposed between the directional sleeve 38 and the hammer 40, remain in the same position as in FIG. 18C (see FIG. 20C), and the directional sleeve 38 continues to rotate with and stay in the same relative axial position to the hammer 40. This is because the balls 52 are respectively at the front ends 80A of the grooves 80 of the directional sleeve 38 and in the rear ends 92A of the sloped ramps 92 of the recesses 86, in contact with the stop walls 94, which prevents the directional sleeve 38 from rotating counterclockwise with respect to the hammer 40. However, because the grooves 64 on the drive shaft 36 extend helically in a rotational direction about its axis A opposite to that of the grooves 80 of the directional sleeve 38, the speed differential between the sleeve 38 and the shaft 36 causes the sleeve 38 to "screw" itself back along the tracks 116. Thus, the balls 50 are pushed from the front ends 64A of the grooves 64 toward the rear ends 64B thereof. As the directional sleeve 38 moves rearwardly it carries the hammer 40 with it away from the anvil 42, causing the compression spring 48 to be compressed. When the energy of the compression spring 48 is released, the compression spring 48 axially pushes the coupled hammer 40 and directional sleeve 38 forwardly toward the anvil 42. The balls 50 travel in a direction from the rear ends 64B back toward the front ends 64A of the grooves 64 and rotationally accelerates, along with the hammer 40, with respect to the drive shaft 36, causing the ears 96 of the hammer 40 to strike the ears 108 of the anvil 42 with a high impact to tighten or loosen the coupled fastener of the fastener joint. If, as with clockwise rotation of the drive shaft 36 described above, the resistance torque in the fastener joint is above a given threshold at the anvil/hammer impact, this process will be repeated, as described immediately above, and the hammer 40 will intermittently impart blows to the anvil 42.

As with the axial rearward movement of the hammer 40 when the shaft is rotating clockwise, the amount of axial rearward travel of the hammer 40 and the coupled directional sleeve 38 is dependent on the amount of rebound exerted by the joint on the hammer 40. Depending upon the amount of rebound exerted by the joint on the hammer 40, the hammer 40 and coupled directional sleeve 38 will move axially rearwardly until the axial force of the hammer 40 and coupled directional sleeve 38 is less than the stored force of the compression spring 48 or until the balls 50 reach the rear ends 64B of the grooves 64 which prevent further axial rearward movement of the hammer 40 and coupled directional sleeve 38.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A reversible rotary impact mechanism for applying intermittent torque impulses to a load, the mechanism comprising:

a shaft rotatable about an axis and adapted to be coupled to a motive source;

a rotatable anvil for coupling to the load and having an anvil ear;

an axially and rotatably moveable tubular hammer substantially coaxial with the shaft and having a hammer ear engageable with the anvil ear;

a rotatable tubular drive coupling member having inner and outer cylindrical surfaces substantially coaxial with the shaft;

a first helical cam structure coupling the shaft to only the inner surface of the drive coupling member;

a second helical cam structure coupling the hammer to only the outer surface of the drive coupling member; and a bias member resiliently biasing the hammer axially toward the anvil to engage the hammer ear with the anvil ear, whereby when the shaft is rotated in a first direction and torque exerted by the anvil ear on the hammer ear exceeds a given threshold, the first helical cam structure responds to rotation of the shaft to move the drive coupling member axially away from the anvil to disengage the hammer ear from the anvil ear, and when the shaft is rotated in a second direction and torque exerted by the anvil ear on the hammer ear exceeds a given threshold, the second cam structure responds to rotation of the shaft to move the hammer relative to the drive coupling member axially away from the anvil to disengage the hammer ear from the anvil ear.

2. The mechanism of claim 1, wherein the first helical cam structure extends helically in a first rotational direction about the axis of the shaft and the second helical cam structure extends helically in a second rotational direction about the axis of the shaft.

3. The mechanism of claim 2, wherein each of said helical cam structures extends at least 180° in a rotational direction.

4. The mechanism of claim 1, wherein said first and second helical cam structures overlap each other in an axial direction.

5. The mechanism of claim 1, wherein said hammer ear is engageable with said anvil ear along a predetermined axial engagement distance, each of said helical cam structures extending axially a distance substantially greater than said engagement distance.

6. The mechanism of claim 1, wherein said hammer has two diametrically opposed hammer ears and said anvil has two diametrically opposed anvil ears, said helical cam structures being dimensioned so that said impact mechanism delivers fewer than two impacts per revolution of the shaft.

7. The mechanism of claim 1, wherein said first cam structure includes a first cam surface disposed on the shaft and a first mating cam surface disposed on only the inner surface of the drive coupling member for cooperation with the first cam surface to define a first helical track, and a first ball disposed in the first track; and the second cam structure includes a second cam surface disposed on only the outer surface of the drive coupling member, a second mating cam surface disposed on the hammer for cooperation with the second cam surface to define a second helical track, and a second ball disposed in the second track.

8. The mechanism of claim 1, wherein the first cam structure includes a plurality of first cam surfaces disposed on the shaft, a plurality of first mating cam surfaces disposed on only the inner surface of the drive coupling member for cooperation respectively with the first cam surfaces to define a plurality of first tracks, and a plurality of first balls respectively disposed in the first track; and the second cam structure includes a plurality of second cam surfaces disposed on only the outer surface of the drive coupling member, a plurality of second mating cam surfaces disposed on the hammer for cooperation respectively with the second cam surfaces to define a plurality of second tracks, and a plurality of second balls respectively disposed in the second tracks.

9. A reversible rotary impact mechanism for applying intermittent torque impulses to a load, the mechanism comprising:

a shaft rotatable about an axis and adapted to be coupled to a motive source and having a first helical cam surface thereon;

a rotatable anvil for coupling to the load and having an anvil ear;

an axially and rotatably movable tubular hammer substantially coaxial with the shaft and having a hammer ear engageable with the anvil ear and having a second helical cam surface thereon;

a rotatable tubular drive coupling member having inner and outer cylindrical surfaces substantially coaxial with the shaft, said drive coupling member having a third helical cam surface formed in only the inner surface thereof disposed for cooperation with said first cam surface for defining a first helical track, said drive coupling member having a fourth helical cam surface formed in only the outer surface thereof and disposed for cooperation with said second helical cam surface for defining a second helical track;

first and second balls respectively disposed in said first and second tracks; and bias mechanism resiliently biasing the hammer axially toward the anvil to engage the hammer ear with the anvil ear.

10. The mechanism of claim 9, wherein the first helical track extends helically in a first rotational direction about the axis of the shaft and the second helical track extends helically in a second rotational direction about the axis of the shaft.

11. The mechanism of claim 9, wherein each of said first and second helical tracks extends at least 180° in a rotational direction.

12. The mechanism of claim 9, wherein said first and second helical tracks overlap each other in an axial direction.

13. The mechanism of claim 9, wherein said hammer ear is engageable with said anvil ear along a predetermined axial engagement distance, each of said helical tracks extending axially a distance substantially greater than said engagement distance.

14. The mechanism of claim 9, wherein each of said cam surfaces is in the form of a helical groove.

* * * * *